US010928071B2

(12) United States Patent
Mi

(10) Patent No.: US 10,928,071 B2
(45) **Date of Patent: *Feb. 23, 2021**

(54) GASKETS AND A METHOD FOR MAKING THE SAME

(71) Applicant: JIANGSU SANYOU DIOR ENERGY-SAVING NEW MATERIALS CO., LTD., Jiangsu (CN)

(72) Inventor: Yueqi Mi, Shenzhen (CN)

(73) Assignee: JIANGSU SANYOU DIOR ENERGY-SAVING NEW MATERIALS CO., LTD., Changzhou (CN)

( * ) Notice: Subject to any disclaimer, the term of this patent is extended or adjusted under 35 U.S.C. 154(b) by 46 days.

This patent is subject to a terminal disclaimer.

(21) Appl. No.: 16/246,450

(22) Filed: Jan. 11, 2019

(65) Prior Publication Data

US 2019/0145629 A1 May 16, 2019

Related U.S. Application Data

(63) Continuation of application No. 15/847,857, filed on Dec. 19, 2017, now Pat. No. 10,240,798.

(30) Foreign Application Priority Data

Jan. 13, 2017 (CN) ..... 201710025947.1

(51) Int. Cl.

| | |
|---|---|
| ***E06B 7/16*** | (2006.01) |
| ***F24C 15/02*** | (2006.01) |
| ***F25D 23/08*** | (2006.01) |

(52) U.S. Cl.
CPC ..... *F24C 15/021* (2013.01); *E06B 7/16* (2013.01); *F25D 23/087* (2013.01)

(58) Field of Classification Search
CPC ..... F24C 15/021; F24C 15/02; E06B 7/16; E06B 5/164; E06B 7/098; F25D 23/087
(Continued)

(56) References Cited

U.S. PATENT DOCUMENTS 373,792 A 11/1887 Yarlot
2,924,471 A 2/1960 Poltorak et al.
(Continued)

FOREIGN PATENT DOCUMENTS

CN 2577153 Y 10/2003
CN 2704771 Y 6/2005
(Continued)

OTHER PUBLICATIONS

International Search Report in International Application No. PCT/CN2017/101689 dated Dec. 20, 2017, 5 pages.
(Continued)

*Primary Examiner* — Nathan Cumar
(74) *Attorney, Agent, or Firm* — METIS IP LLC

(57) ABSTRACT

A gasket may include a tubular section which has a protection layer and a mesh layer. The protection layer may form a first tube, and the mesh layer may form a second tube, which may be enclosed in the first tube. The mesh layer may be formed by a metal wire in a spiral fashion extending along an axial direction of the second tube. The mesh layer may provide an elastic support to the protection layer when the protection layer tube is pressed by an external force.

20 Claims, 8 Drawing Sheets

(58) Field of Classification Search
USPC ..... 277/652
See application file for complete search history.

(56) References Cited

U.S. PATENT DOCUMENTS

| | | | | |
|---|---|---|---|---|
| 3,578,764 | A * | 5/1971 | Nunnally | F24C 15/021 87/6 |
| 4,538,381 | A | 9/1985 | Vogel | |
| 7,124,540 | B2 * | 10/2006 | Qiang | F24C 15/021 49/492.1 |
| 7,375,291 | B2 * | 5/2008 | Ariel | H05K 9/0015 174/358 |
| 9,086,149 | B2 | 7/2015 | Qiang et al. | |
| 9,447,628 | B2 | 9/2016 | Qiang et al. | |
| 2004/0026874 | A1 * | 2/2004 | Flasher | F16J 15/065 277/628 |
| 2004/0124590 | A1 * | 7/2004 | Hight, Jr. | B21D 53/36 277/630 |
| 2014/0312618 | A1 | 10/2014 | Shionoya et al. | |

FOREIGN PATENT DOCUMENTS

| | | | |
|---|---|---|---|
| CN | 201310623 | Y | 9/2009 |
| CN | 201461948 | U | 5/2010 |
| CN | 102359592 | A | 2/2012 |
| CN | 203788989 | U | 8/2014 |
| CN | 206530233 | U | 9/2017 |
| GB | 792194 | A | 3/1958 |
| JP | 3205367 | U | 7/2016 |
| WO | 2008076581 | A2 | 6/2008 |
| WO | 2018129947 | A1 | 7/2018 |

OTHER PUBLICATIONS

Written Opinion in International Application No. PCT/CN2017/101689 dated Dec. 20, 2017, 5 pages.
First Office Action in Chinese Application No. 201710025947.1 dated Jan. 3, 2018, 13 pages.
Second Office Action in Chinese Application No. 201710025947.1 dated May 17, 2018, 14 pages.

* cited by examiner

GASKETS AND A METHOD FOR MAKING THE SAME

CROSS-REFERENCE TO RELATED APPLICATIONS

This application is a continuation application of U.S. patent application Ser. No. 15/847,857, filed on Dec. 19, 2017, which is a continuation of International Application No. PCT/CN2017/101689, filed on Sep. 14, 2017, which claims priority of Chinese Patent Application No. 201710025947.1, filed on Jan. 13, 2017, the entire contents of which are hereby incorporated by reference.

TECHNICAL FIELD

The present disclosure generally relates to a gasket, and more particularly, to a gasket including a mesh layer.

BACKGROUND

Thermal appliances, such as ovens, generally have a cavity (also referred to a "heat capacity room") and a door configured to cover one end of the cavity. In order to prevent heat inside the cavity from escaping through the space between the cavity and the door when the door is closed, a gasket may be used to fill the space. The gasket may include an inner support and an outer tubular member made of, for example, glass fiber. It is desirable to provide a properly designed structure and configuration of the inner support to support the outer tubular member when the outer tubular member is pressed by other components of the oven such as the door and the cavity.

SUMMARY

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

An aspect of the present disclosure provides a gasket. The gasket may include a tubular section which has a protection layer and a mesh layer. The protection layer may form a first tube, and the mesh layer may form a second tube, which may be enclosed in the first tube. The mesh layer may be formed by a metal wire in a spiral fashion extending along the axial direction of the second tube. The mesh layer may provide an elastic support to the protection layer when the protection layer tube is pressed by an external force.

In some embodiments, the metal wire forming the mesh layer may include a plurality of Ω-shaped elements. A bottom part of one Ω-shaped element of the plurality of Ω-shaped elements may integrate with a bottom part of another Ω-shaped element of the plurality of Ω-shaped elements, and the one Ω-shaped element may abutt the another Ω-shaped element.

In some embodiments, the plurality of Ω-shaped elements may form a plurality of layers of Ω-shaped elements along the axial direction of the second tube. The plurality of Ω-shaped elements may have a first layer of Ω-shaped elements and a second layer of Ω-shaped elements. The first layer may abut the second layer in the axial direction of the second tube. Each of Ω-shaped elements of the first layer may thread through a corresponding Ω-shaped element of the second layer. A portion of the each Ω-shaped element in the first layer may be above the corresponding Ω-shaped element in the second layer in a radial direction of the second tube. Another portion of the each Ω-shaped element in the first layer may be under the corresponding Ω-shaped element in the second layer in the radial direction of the second tube.

In some embodiments, the Ω-shaped elements of the first layer may be movable with respect to the Ω-shaped elements of the second layer.

In some embodiments, the metal wire may be made of stainless steel.

In some embodiments, the protection layer may be formed by a thread of glass fiber.

In some embodiments, the gasket may further include an extension section extending outward in a radial direction of the tubular section, and the extension section may be integrated with the protection layer.

In some embodiments, the gasket may further include a plurality of stitches. The extension section may have two sides, and the plurality of stitches tie the two sides of the extension section together. The plurality of stitches may form a line parallel to the axial direction of the tubular section.

In some embodiments, the tubular section may have a first width in a squashed state, and the extension section may a second width in a squashed state. The ratio between the second width and the first width may be in a range of 1/5 to 3/5.

In some embodiments, the gasket may further include a plurality of fasteners. A part of each of the plurality of fasteners may be embedded in the tubular section.

In some embodiments, one of the plurality of fasteners may have a base portion and a dart portion, and the base portion is within the second tube.

In some embodiments, the dart portion of the one of the plurality of fasteners may form an angle with a plane defined by an axis of the extension section and an axis of the tubular section. The angle may be smaller than 90 degrees.

In some embodiments, an end of the dart portion of the one of the plurality of fasteners may bend toward an inner edge of the dart portion.

In some embodiments, the protection layer may have an inner surface and an outer surface. At least one of the inner surface or the outer surface may be coated with a lubricant material.

In some embodiments, the lubricant material may include graphite.

Another aspect of the present disclosure provides a mesh tube. The mesh tube may include a plurality of Ω-shaped elements. A bottom part of one Ω-shaped element of the plurality of Ω-shaped elements may integrate with a bottom part of another Ω-shaped element of the plurality of Ω-shaped elements, and the one Ω-shaped element may abut the second Ω-shaped element.

Another aspect of the present disclosure provides a method for making a gasket. The method may include acquiring a tubular fabric and dividing the tubular fabric into at least two parts by stitching the tubular fabric along a line parallel to an axis of the tubular fabric. The method may further include inserting a mesh tube into one of the at least two parts of the tubular fabric, and installing one or more fasteners on the one of the at least two parts of the tubular fabric.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1A:
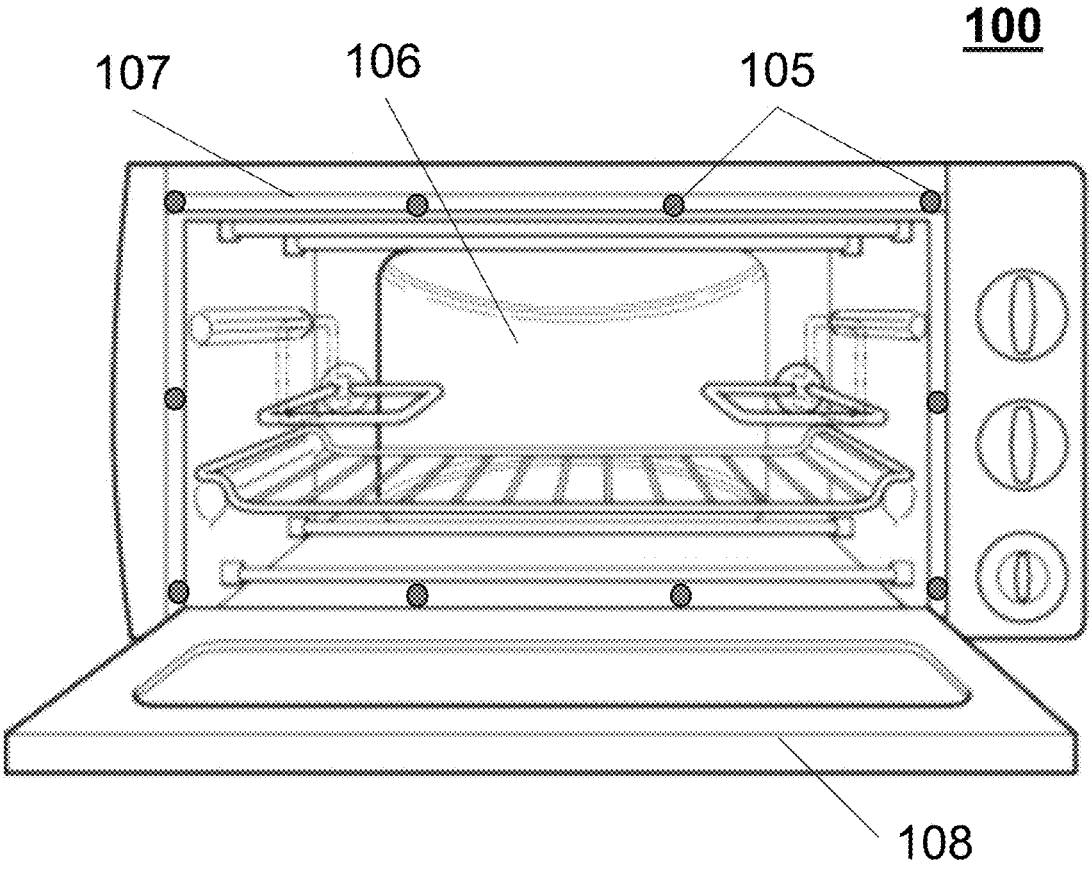
FIG. 1A illustrates an exemplary thermal appliance according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is to describe particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that the term "first," "second," and/or "third" used herein are one method to distinguish different components, elements, parts, section or assembly of different level in ascending order. However, the terms may be displaced by another expression if they achieve the same purpose.

It will be understood that when a component or element is referred to as being "connected to," or "coupled to," another component, or element, it may be directly connected or coupled to. As used herein, the term "and/or" includes any and all combinations of one or more of the associated listed items.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

Provided herein is a gasket including a tubular section with a mesh tube enclosed in the tubular section. The mesh tube may include a plurality of Ω-shaped elements arranged in a spiral fashion extending along an axial direction of the mesh tube. When the tubular section is pressed by an external force, the mesh tube may provide an elastic support to the tubular section. The gasket may also include an extension section integrated with the tubular section and a plurality of fasteners mounted on the tubular section. The gasket may be mounted to a thermal appliance by the plurality of fasteners in association with the extension section.

FIG. 1A illustrates an exemplary thermal appliance 100 according to some embodiments of the present disclosure. The thermal appliance 100 may include a device that is capable of maintaining a temperature inside the device different from the ambient temperature. Exemplary thermal appliances may include an oven, a refrigerator, a refrigerated container, or the like, or a combination thereof. The thermal appliance 100 may include a heat capacity room 106 and a door 108. The door 108 may be placed against an end 107 of the heat capacity room 106 to cover the heat capacity room 106. For example, the door 108 may rotate about one side of the end 107, via, for example, one or more hinges (not shown), to cover the heat capacity room 106. The end 107 may include a plurality of positioning elements 105 configured to fasten a gasket.

The positioning elements 105 may be located at different positions of the end 107. For example, at least one positioning element 105 may be located at a corner of the end 107. The positioning elements 105 may be uniformly or randomly distributed on the end 107. As shown in FIG. 1A, four positioning elements 105 may be distributed at the upper side of the end 107 with a uniform interval between two adjacent positioning elements.

Figure 1B:
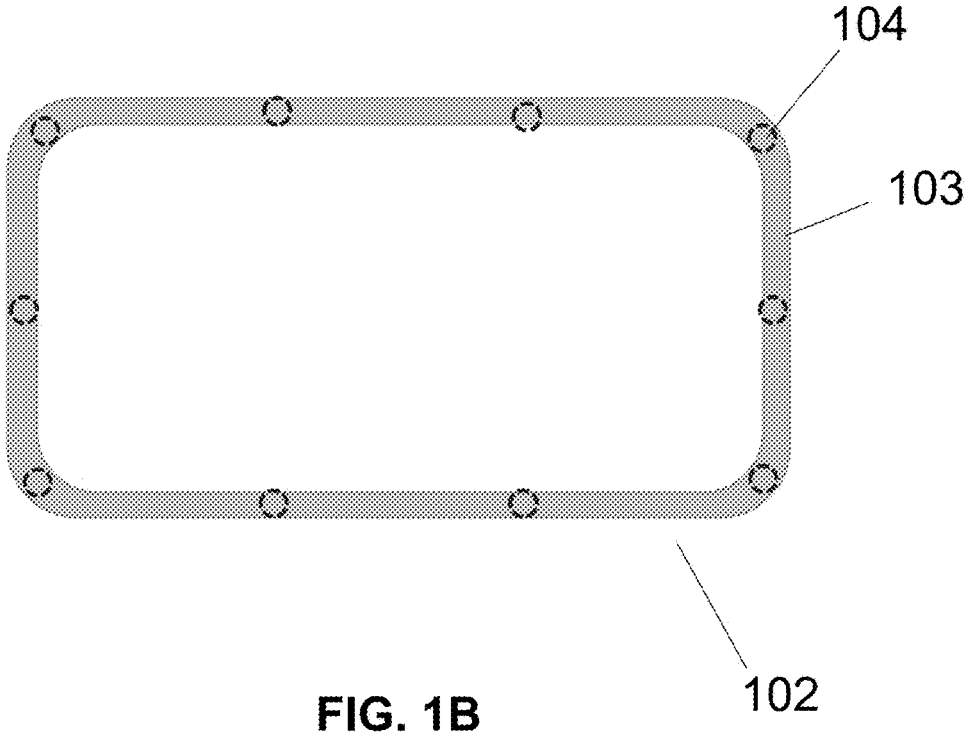
FIG. 1B illustrates a side view of an exemplary gasket according to some embodiments of the present disclosure.

FIG. 1B illustrates a side view of an exemplary gasket 102 according to some embodiments of the present disclosure. The gasket 102 may form a closed loop to fill the space between the end 107 and the door 108 to prevent heat inside the cavity from escaping outside. The gasket 102 may include a body 103 and a plurality of fasteners 104.

The body 103 may include a tubular section. The tubular section of the body 103 may be compressible along the radial direction such as to closely attach to the end 107 and the door 108. The fastener 104 may be configured to mount the gasket 102 onto the end 107 via, for example, the positioning element 105. Merely by way of example, the fastener 104 may include a dart portion, and the positioning element 105 may include a hole that accommodates the dart portion of the fastener 104 such that the fastener 104 may attach to the positioning elements 105, thereby mounting the gasket 102 to the end 107. Additionally or alternatively, the fastener 104 and the positioning element 105 may form a coupling structure configured to attach to each other. Exemplary coupling structure may include a bolt, a screw, a nut, an airtight glue, or an airtight adhesive tape.

This description is intended to be illustrative, and not to limit the scope of the present disclosure. Many alternatives, modifications, and variations will be apparent to those skilled in the art. The features, structures, methods, and other characteristics of the exemplary embodiments described herein may be combined in various ways to obtain additional and/or alternative exemplary embodiments. For example, the positioning elements 105 may be arranged on the door 108. The gasket 102 may be mounted on the door 108 when the door 108 is separated from the end 107. However, those variations and modifications do not depart the scope of the present disclosure.

Figure 2:
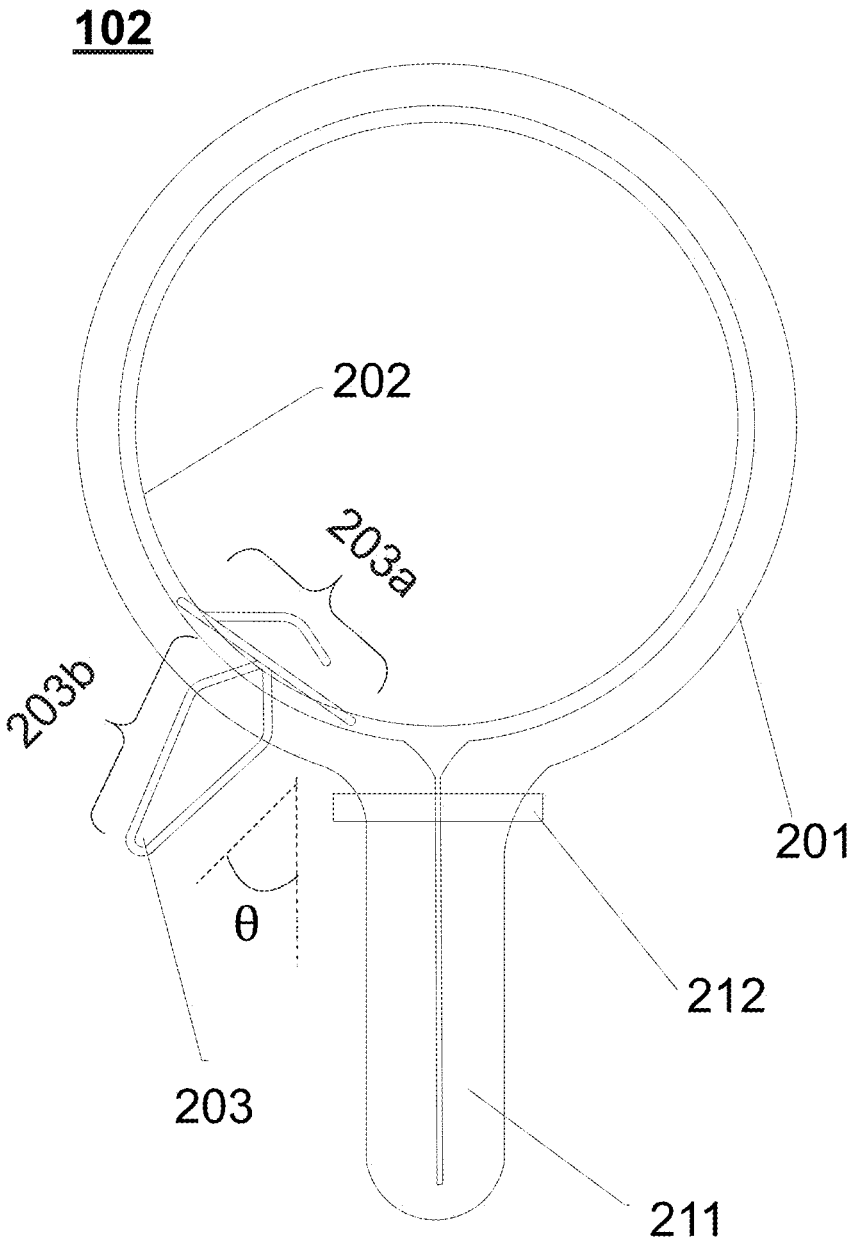
FIG. 2 is a schematic diagram illustrating a cross section of an exemplary gasket according to some embodiments of the present disclosure.

FIG. 2 is a schematic diagram illustrating a cross section of an exemplary gasket according to some embodiments of the present disclosure. The gasket 102 may include a protection layer 201, a mesh layer 202, a fastener 203, an extension section 211, and a plurality of stitches 212.

The protection layer 201 may form a tube. The tube may include a hollow cavity that encloses the mesh layer 202 and protects the mesh layer 202 from touching, for example, the door 108 and the end 107 of the thermal appliance 100. As shown in FIG. 2, the cross section of the protection layer 201 may have a shape of a circle in a rest state (i.e., no force being applied on it). Alternatively, the cross section of the protection layer 201 may have any other suitable shapes in the rest state, for example, a shape of a rectangle, a shape of an oval, or a shape of a polygon.

In some embodiments, the protection layer 201 may be fabricated by braiding a plurality of yarns into a texture. Exemplary textures may include tabby, cross grain, satin weave, or the like, or a combination thereof. The texture may be braided according to a drafting design. Exemplary drafting design may include a straight draft, a skipped draft, a chevron-like draft, a broken draft, a divided draft, or the like, or a combination thereof. Merely by way of example, the protection layer 201 may be braided into satin weave according to a straight draft.

Due to the adverse environmental conditions to which the protection layer may be exposed (e.g., heat and smoke from the heat capacity room 106, long-term compression and repeated flexures from opening and closing the door 108), the plurality of yarns may be made of one or more suitable materials. In some embodiments, the yarns may be made of heat resistant and insulated materials. For example, the plurality of yarns may be made of polymer materials. Exemplary polymer materials may include silicone, polyvinyl chloride (PVC), polyethylene (PE), ethylene vinyl acetate copolymer (EVA), polypropylene (PP), polystyrene (PS), acrylonitrile butadiene styrene acrylonitrile butadiene styrene (ABS), polymethyl methacrylate (PMMA), polyurethane (PU), polyurethane elastomer (UE), polyamide (PA), polycarbonate (PC), polyformaldehyde (POM), polyethylene terephthalate (PET), polyphenylene ether (PPO), polytetrafluoroethylene (PTFE), polyphenylene sulfide (PPS), polyimide (PI), or the like, or a combination thereof. As another example, the plurality of yarns may be made of inorganic materials, for example, ceramic fiber and carbon fiber. Exemplary ceramic fiber may include glass fiber, common aluminum silicate fiber, high aluminum silicate fiber, chromium-doped aluminum silicate fiber, zirconium-doped aluminum silicate fiber, forsterite fiber, silicon dioxide-calcium oxide-magnesium oxide composite fiber, or the like, or a combination thereof. Exemplary glass fiber may include alkali-free glass fiber, medium-alkali glass fiber, or the like, or a combination thereof. As still another example, the plurality of yarns may be made of metals. Exemplary resilient metal wire may include stainless-steel wire, silver wire, or the like, or a combination thereof. In some embodiments, the protection layer 201 may be fabricated by braiding different types of yarns. For example, the protection layer 201 may be fabricated by intertwining glass fiber yarn(s) and metal wire(s).

The protection layer 201 may have an outer surface and an inner surface. At least one of the outer surface and the inner surface may be coated with one or more lubricant materials. The lubricant material coating the outer surface and/or the inner surface may include an inorganic lubricant material or an organic lubricant material. Exemplary inorganic lubricant material may include graphite, graphene, molybdenum disulfide, oxide, or the like, or a combination thereof. Exemplary organic lubricant material may include polytetrafluoroethylene (PTFE), polyethylene (PE), oil, or the like, or a combination thereof. The outer surface and/or the inner surface may be coated through one or more coating techniques. Exemplary coating technique may include a brush coating technique, a rolling coating technique, a spray coating technique, a flame spray coating technique, a plasma spray coating technique, a vacuum deposition technique, a chemical vapor deposition technique, an impregnation coating technique, an ultrasound coating technique, or the like, or a combination thereof. In some embodiments, the coating process may be performed before or after the texture that forms the protection layer 201 is braided. For example, the texture may be fabricated by braiding the yarns that have been coated with a lubricant material. Alternatively, the texture may be fabricated by braiding uncoated yarns firstly and then coating the braided yarns with one or more lubricant materials. Alternatively, the texture may be fabricated by braiding the yarns that have been coated with a lubricant material, and the texture may further be coated with the same or a different lubricant material.

The mesh layer 202 may form a mesh tube that is enclosed in the protection layer 201. The mesh layer 202 may provide an elastic support (e.g., a resilient force) to the protection layer 201 when the protection layer 201 is pressed by, for example, the door 108 and the end 107.

In some embodiments, the mesh layer 202 may be knitted by at least a metal wire. Exemplary metal wires may include a stainless-steel wire, a silver wire, a copper wire, or the like, or a combination thereof. The diameter of the metal wire may be in a range of 0.01 to 1 millimeter. In some embodiments, the diameter of the metal wire may be restricted to a sub-range of 0.01 to 0.05 millimeters, 0.05 to 0.1 millimeters, 0.1 to 0.5 millimeters, 0.5 to 1 millimeter. Merely by way of example, the mesh layer 202 may be knitted by a stainless-steel wire having a 0.1 millimeters.

Figure 7:
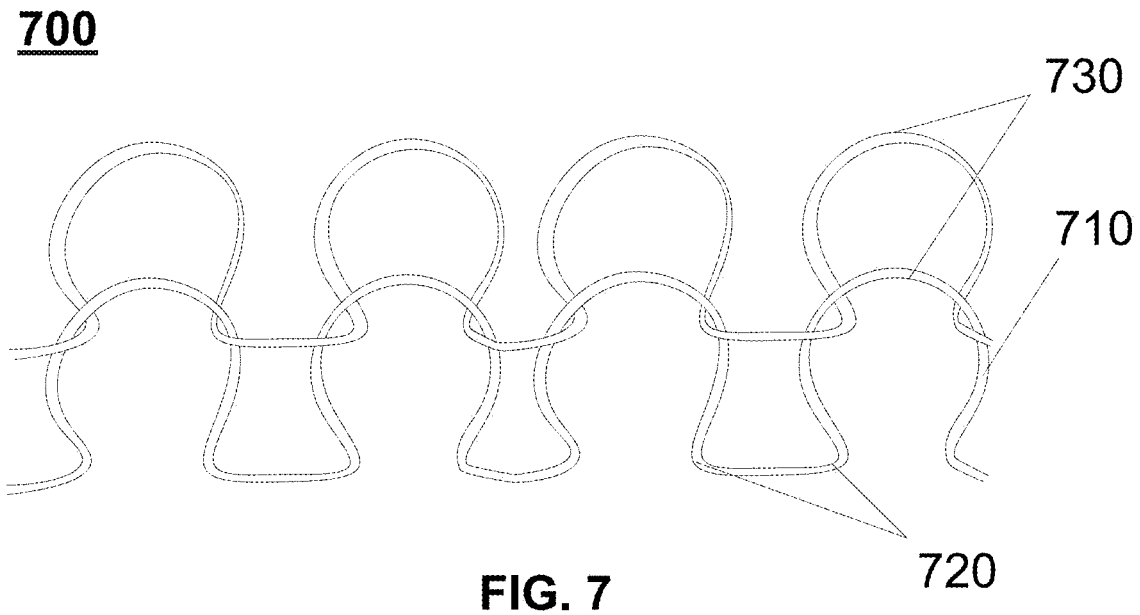
FIG. 7 is a schematic diagram illustrating a structure of a portion of an exemplary mesh layer according to some embodiments of the present disclosure.

In some embodiments, the mesh layer 202 may include a plurality of unit elements (e.g., the Ω-shaped element illustrated in FIG. 7). A unit element may have various shapes, for example, a Ω-shape (or horse-shoe shape), or a rhombus shape. The unit elements may be arranged in a plurality of unit-element layers along the axial direction of the mesh layer. A unit element in a unit-element layer may integrate with an adjacent unit element in the same unit-element layer. In some embodiments, the number of unit elements in different unit-element layers of the mesh layer 202 may be the same or different.

In some embodiments, the unit-element layers of the mesh layer 202 may extend spirally along the axial direction of the mesh layer. For example, two adjacent unit-element layers of the mesh layer 202 may be knitted from a single metal wire, and thus the unit elements in one unit-element layer of the two adjacent unit-element layers may integrate with the unit elements in the other unit-element layer of the two adjacent unit-element layers. Alternatively, at least two unit-element layers of mesh layer 202 may be arranged in a parallel fashion. For example, each of two adjacent unit-element layers of the mesh layer 202 may be knitted from an independent metal wire, and the two adjacent unit-element layers may further twist with each other.

In some embodiments, the gasket 102 may include more than one mesh layer. The mesh layers may be arranged in the manner that the mesh layer having a greater diameter encloses the mesh layer having a smaller diameter. Additionally or alternatively, the gasket 102 may include a first mesh layer having a diameter greater than that of the protection layer 201. The first mesh layer may enclose the protection layer 201, which may enclose a second mesh layer. The first and second mesh layers may be made of the same or different material. The first and second mesh layers may have the same or different type of unit elements. In addition, the configuration of the unit elements of the first and second mesh layers may be the same or different.

The fastener 203 may be configured to mount the gasket 102 on a thermal appliance (e.g., the thermal appliance 100). As shown in FIG. 2, the fastener 203 may be installed on the lower portion of the protection layer 201 (e.g., the portion that is below the axis of the protection layer 201). The fastener 203 may include a base portion 203*a* and a dart portion 203*b*. The base portion 203*a* may be embedded in the protection layer 201, and the dart portion 203*b* may stick out of the protection layer 201. The dart position 203*b* may form an angle θ with the axial plane of the protection layer 201 and the extension section 211. As used herein, the axial plane may be defined by the axis of the extension section 211 and the axis of the protection layer 201. The angle may be in a range of 0 degree to 90 degrees. In some embodiments, the angle may be restricted to a sub-range of 10 degrees to 60 degrees, or 20 degrees to 45 degrees. More descriptions regarding the fastener may be found elsewhere in the disclosure (e.g., FIG. 6 and the description thereof).

The extension section 211 may integrate with the protection layer 201. In some embodiments, the extension section 211 may be knitted from the same yarns (or the same texture sheet) forming the protection layer 201. For example, the extension section 211 may be knitted from a first portion of a thread of yarn, and the protection layer 201 may be knitted from a second portion of the same thread of yarn. In some embodiments, the extension section 211 and the protection layer 201 may be knitted from different yarns.

As shown in FIG. 2, the extension section 211 may be a tube in a squashed state. The extension section 211 may be inserted into a reserved gap in a thermal appliance (e.g., the thermal appliance 100) to facilitate the installation of the gasket 102 to the thermal appliance, and further prevent heat from escaping. In some embodiments, a mesh layer may be enclosed in the extension section 211 to provide an elastic support to the extension section 211 when the extension section 211 is pressed by an external force. In some embodiments, the extension section 211 may have two sides, and a plurality of stitches 212 may be configured to tie the two sides of the extension section 211. The stitches 212 may form a line parallel to the axis of the protection layer 201. In some embodiments, the stitches 212 may separate the protection layer and the extension section 211.

In some embodiments, the stitches 212 may be made of the same materials as the protection layer 201. For example, both of the protection layer 201 and the plurality of stitches 212 may be made of glass fiber coated with graphite. In some embodiments, the material of the stitches 212 may be different from that of the protection layer 201. For example, the plurality of stitches 212 may be made of glass fiber without the coating of graphite, and the protection layer 201 may be made of glass fiber coated with graphite.

It should be noted that the description regarding the gasket 102 is provided for the purposes of illustration, and not intended to limit the scope of the present disclosure. For persons having ordinary skills in the art, various variations and modifications may be conducted under the guidance of the present disclosure. However, those variations and modifications do not depart the scope of the present disclosure. For example, the extension section 211 may be omitted. As another example, the protection layer 201 and the extension section 211 may be separated by a hot-pressing technique instead of the plurality of stitches 211. As still another example, the protection layer 201 and the mesh layer 202 may be braided form a single layer. However, those variations and modifications do not depart the scope of the present disclosure.

Figure 3:
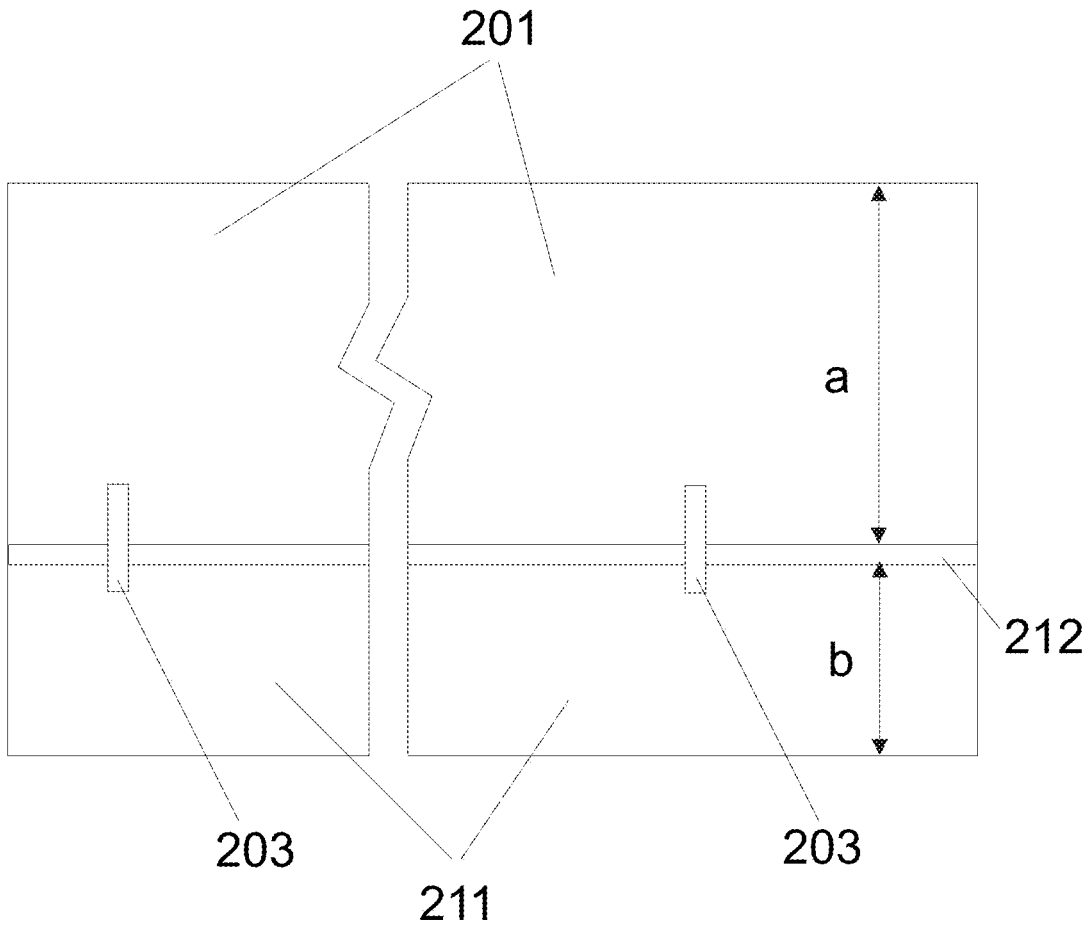
FIG. 3 is a schematic diagram illustrating a side view of an exemplary gasket according to some embodiments of the present disclosure.

FIG. 3 is a schematic diagram illustrating a side view of an exemplary gasket according to some embodiments of the present disclosure. As shown, each of the side views of the protection layer 201 and the extension section 211 may be a rectangle. The protection layer 201 and the extension section 211 may be delimited by the plurality of stitches 212, which are around the midway between the protection layer 201 and the extension section 211. When the protection layer 201 is in a squashed state (e.g., the left portion of the protection layer 201 and the right portion of the protection layer 201 are pressed to each other), the distance between the top of the protection layer 201 and the bottom of the protection layer 201 (also referred to as the width of the protection layer 201) may be expressed as "a" (and labeled as "a" in FIG. 3). When the extension section 211 is in a squashed state (e.g., illustrated in FIG. 2), the distance between the top of the extension section 211 and the bottom of the extension section 211 (also referred to as the width of the extension section 211) may be expressed as "b" (and labeled as "b" in FIG. 3). In some embodiments, the ratio of the width of the extension section 211 to the width of the protection layer 201 (i.e., the value of b/a) may be in a range of 1/5 to 4/5, 1/5 to 3/5, 2/5 to 3/5, or 2/5 to 1/2.

The fastener 203 may be installed on the protection layer 201. For example, the interval between two adjacent fasteners may be a fixed value. Merely by way of example, the interval may be in the range of 1 centimeter to 100 centimeters. In some embodiments, the interval may be restricted to a sub-range of 1-5 centimeters, 5-10 centimeters, 10-20 centimeters, 20-50 centimeters, or 50-100 centimeters. Alternatively, the fastener 203 may be installed on the protection layer 201 in an irregular way. For example, the fasteners 203 may be disposed according to the positions of the plurality of positioning elements (e.g., positioning elements 105 illustrated in FIG. 1A) in a thermal appliance. In such case the interval between fasteners located close to a corner of the thermal appliance may be different from the interval between fasteners located away from the corner (as in the exemplary configuration of the positioning elements 105 shown in FIG. 1A and corresponding configuration of the fasterners 104 shown in FIG. 1B).

It should be noted that the description regarding the gasket 102 is provided for the purposes of illustration, and not intended to limit the scope of the present disclosure. For persons having ordinary skills in the art, various variations and modifications may be conducted under the guidance of the present disclosure. However, those variations and modifications do not depart the scope of the present disclosure. For example, the protection layer 201 may have a curved face, and the top edge of the protection layer 201 may be a curved line. However, those variations and modifications do not depart the scope of the present disclosure.

Figure 4:
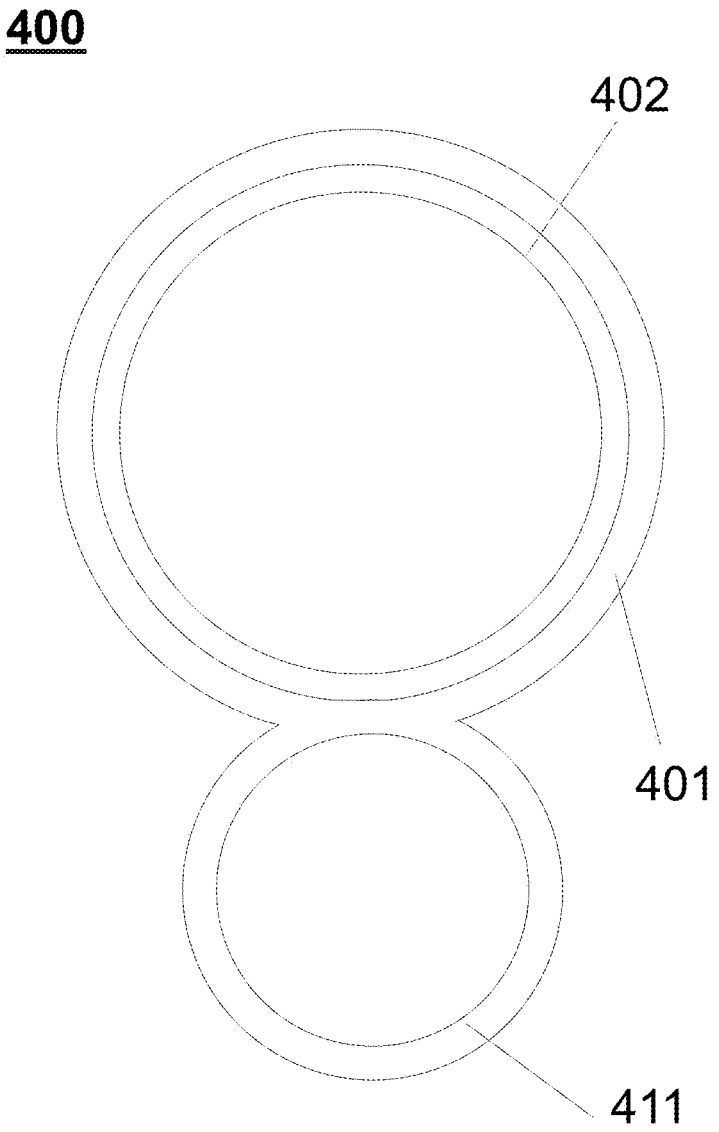
FIG. 4 is a schematic diagram illustrating a cross section of an exemplary gasket according to some embodiments of the present disclosure.

FIG. 4 is a schematic diagram illustrating a cross section of an exemplary gasket according to some embodiments of the present disclosure. The gasket 400 may include a protection layer 401, a mesh layer 402, and an extension section 411. The protection layer 401 may be similar to the protection layer 201 illustrated in FIG. 2, and the mesh layer 402 may be similar to the mesh layer 202 illustrated in FIG. 2; thus, the descriptions thereof are not repeated here.

The extension section 411 may form a tube, which may have a similar shape to the shape of the protection portion 401. The extension section 411 and the protection portion 401 may be knitted from the same yarns. In this case, the extension section 411 and the protection portion 401 may be separately knitted from different portions of the same yarns and then knitted together.

It should be noted that the description about the gasket 400 is provided for the purposes of illustration, and not intended to limit the scope of the present disclosure. For persons having ordinary skills in the art, various variations and modifications may be conducted under the guidance of the present disclosure. However, those variations and modifications do not depart the scope of the present disclosure. For example, more than one extension sections may be knitted. The more than one extension section may have the same or different diameters. However, those variations and modifications do not depart the scope of the present disclosure.

Figure 5:
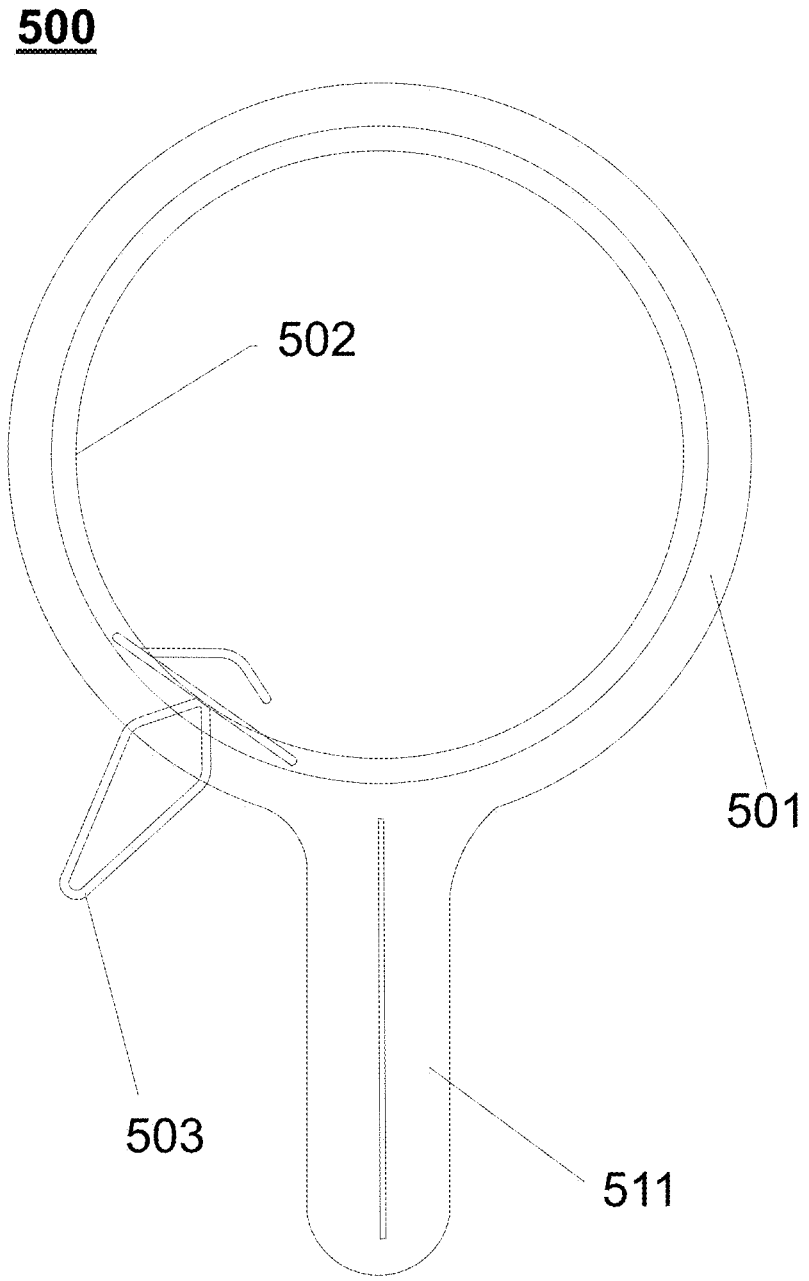
FIG. 5 is a schematic diagram illustrating a cross section of an exemplary gasket according to some embodiments of the present disclosure.

FIG. 5 is a schematic diagram illustrating a cross section of an exemplary gasket according to some embodiments of the present disclosure. The gasket may include a protection layer 501, a mesh layer 502, a fastener 503 and an extension section 511. The protection layer 501 may be similar to the protection layer 401 illustrated in FIG. 4, the mesh layer 502 may be similar to the mesh layer 402 illustrated in FIG. 4, and the fastener 503 may be similar to the fastener 203 illustrated in FIG. 2; thus, the descriptions thereof are not repeated here. The extension section 511 may be in a squashed state, in which the left portion of the extension section 511 and the right portion of the extension section 511 may be pressed and/or tied together.

Figure 6:
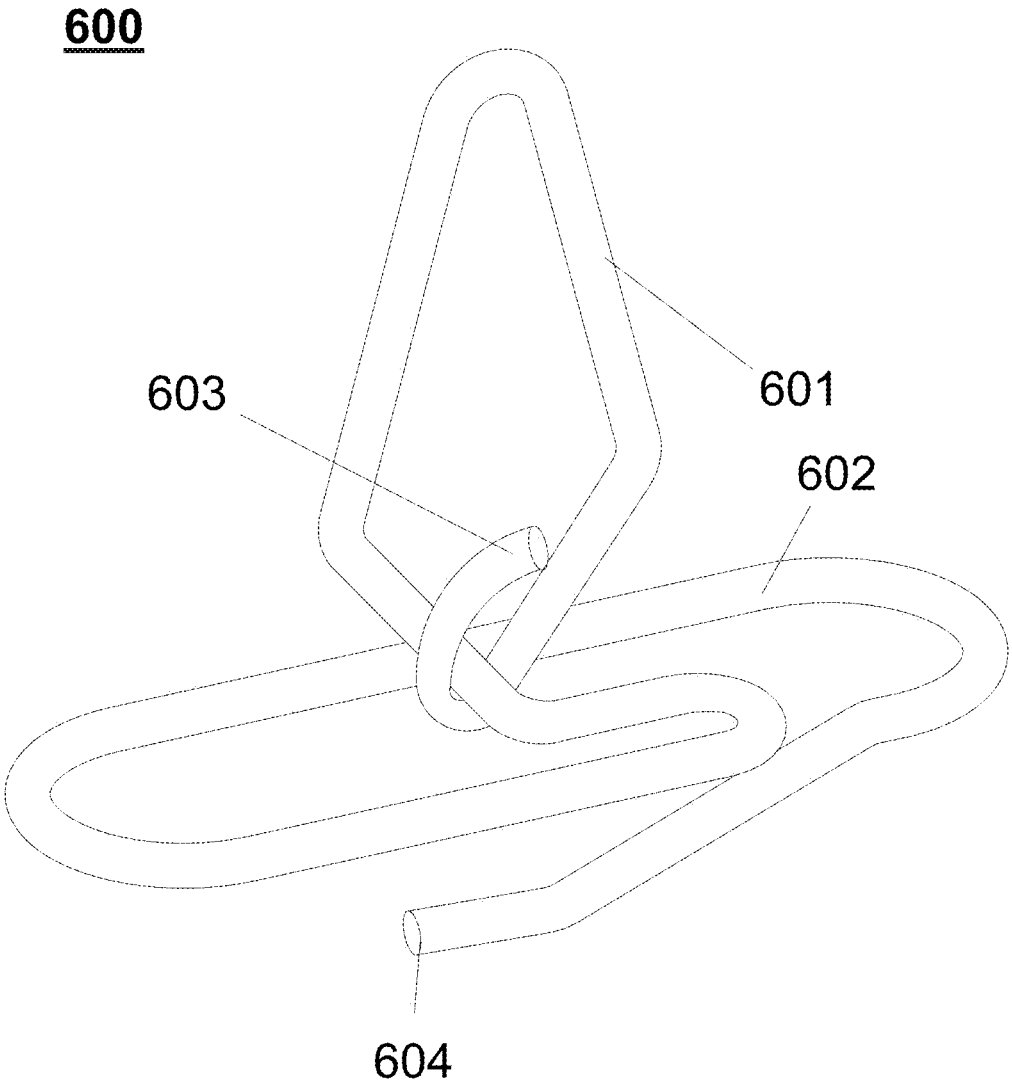
FIG. 6 is a schematic diagram illustrating a structure of an exemplary fastener according to some embodiments of the present disclosure.

FIG. 6 is a schematic diagram illustrating a structure of an exemplary fastener according to some embodiments of the present disclosure. The fastener 600 may be made from a wire. The wire may have a circular or an oval cross section. In some embodiments, the wire may be made of stainless steel. Exemplary stainless steels may include diamond drawn, type 304 stainless steel, 300 and 400 series stainless steel, or the like, or a combination thereof. The wire may be hardened before, during, or after bending into the fastener 600. The wire may be partially (e.g., one-quarter of the length) hardened or fully hardened.

The fastener 600 may have a base portion 602 and a dart portion 601. The base portion 602 may have a base plane. The dart portion 601 may extend transversely or perpendicularly from the base portion 602 (e.g., the center of the base portion 602).

In some embodiments, the dart portion 601 may be formed by bending one end of a single wire into a first structure. The first structure may include a shape of a rhombus or diamond, a shape of an arc, a shape of a Ω-shaped structure, or an irregular shape. The dart portion 601 may include a free end 603. The free end 603 may bend toward an inner edge of the dart portion 601. In some embodiments, the free end 603 may closely attach to the inner edge of the dart portion 601, which may keep the dart portion 601 from loosening or disbanding and keep the free end 603 from threading through outside of a protection layer that catches the fastener 600.

In some embodiments, the base portion 602 may be formed by bending a free end 604 of the single wire into a second structure. The second structure may have a shape of a paper clip, a shape of a hoop, a shape of a rectangle, a shape of a rhombus, or an irregular shape. Merely by way of example, the base portion 602 may have a shape of a paper clip. The paper clip-shaped base portion may have two long length sides. The dart portion 601 may extend from one of the two long length sides. The long length sides may be connected by a pair of opposing curved sides at two ends of the longer length portions. The second free end 604 may be turned below the base plane of the base portion 602. In some embodiments, the second free end 604 may turn away from the base plane of the base portion 602.

It should be noted that the description regarding the fastener 600 is provided for illustration purposes, and not intended to limit the scope of the present disclosure. For persons having ordinary skills in the art, various variations and modifications may be conducted under the guidance of the present disclosure. More descriptions regarding the fastener 600 may be found in, for example, U.S. Pat. No. 9,447,628, the contents of which are incorporated herein by reference.

FIG. 7 is a schematic diagram illustrating a structure of a portion of an exemplary mesh layer according to some embodiments of the present disclosure. The mesh layer 700 may include a plurality of unit elements (i.e., Ω-shaped elements) 710 though two unit-element layers of Ω-shaped elements 710 are shown in FIG. 7 (referred to herein as the first unit-element layer and the second unit-element layer).

The plurality of Ω-shaped elements 710 may be knitted from at least one metal wire. Exemplary metal wire may include a stainless-steel wire, a silver wire, a copper wire, or the like, or a combination thereof. The Ω-shaped element 710 may include a bottom part 720 and a head part 730. The bottom part of a Ω-shaped element in a unit-element layer may integrate with the bottom part of an adjacent Ω-shaped element in the same unit-element layer. The head part of a Ω-shaped element in a unit-element layer may thread through the head part of a corresponding Ω-shaped element in an adjacent unit-element layer. As shown in FIG. 7, a portion (e.g., the bottom part) of each Ω-shaped element in the first unit-element layer is above the corresponding Ω-shaped element in the second unit-element layer. Another portion (e.g., the head part) of the each Ω-shaped element in the first unit-element layer is under the corresponding Ω-shaped element in the second unit-element layer.

The plurality of unit-element layers of the mesh layer 700 may have a tubular configuration and form a tube. In some embodiments, the unit-element layers may extend spirally along the axial direction of the tube. For example, two adjacent unit-element layers may be knitted from a single metal wire, and thus the Ω-shaped elements in one of the two adjacent unit-element layers may integrate with the Ω-shaped elements in the other unit-element layer of the two adjacent unit-element layers. In some embodiments, the unit-element layers may be arranged in a parallel fashion. For example, two adjacent layers may be knitted from two different metal wires respectively, and the Ω-shaped elements in one unit-element layer may thread through the Ω-shaped elements in the other unit-element layer to form the mesh layer 700.

The mesh layer 700 may provide an elastic support to a protection layer (e.g., the protection layer 201), which encloses the mesh layer. The strength of the elastic support may depend on the state of the mesh layer 700. For example, the mesh layer 700 may have a tensional state and a compressive state. As used herein, the tensional state refers to stretching the mesh layer 700 along the axial direction. The compressive state refers to compressing the mesh layer 700 along the axial direction. In a unit length along the axial direction of the mesh layer 700, the number of Ω-shaped elements of the mesh layer 700 in the tensional state may be less than the number of Ω-shaped elements of the mesh layer 700 in the compressive state. Thus, the mesh layer 700 in the compressive state may provide a greater elastic support along the radial direction than the mesh layer 700 in the tensional state. In some embodiments, the strength of the elastic support provided by the mesh layer 700 in the compressive state may be multiple times of the strength of the elastic support provided by the mesh layer 700 in the tensional state. For example, the ratio between the two strengths of the elastic support provided by the mesh layer 700 in the compressive state and the tensional state may be in a range of 1.5 to 2.5.

It should be noted that the description regarding the mesh layer 700 is provided for illustration purposes, and not intended to limit the scope of the present disclosure. For persons having ordinary skills in the art, various variations and modifications may be conducted under the guidance of the present disclosure. For example, the Ω-shaped element may be replaced by another unit element with another proper shape. However, those variations and modifications do not depart the scope of the present disclosure.

Figure 8:
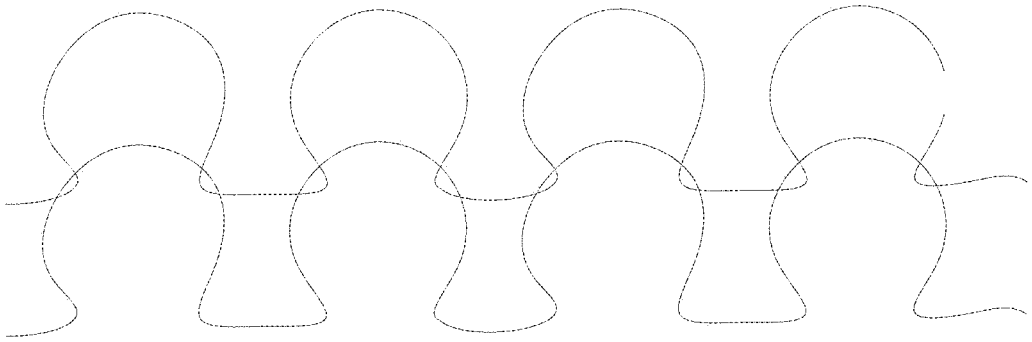
FIG. 8 is a schematic diagram illustrating the mesh layer of FIG. 7 in a tensional state according to some embodiments of the present disclosure.

FIG. 8 is a schematic diagram illustrating the mesh layer 700 of FIG. 7 in a tensional state according to some embodiments of the present disclosure. As shown in FIG. 8, when the mesh layer 700 is in the tensional state, the Ω-shaped elements in the first layer may extend away from the Ω-shaped elements in the second layer along the axial direction of the mesh layer 700. The bottom part of a Ω-shaped element in the first layer may reside close to the head part of a corresponding Ω-shaped element in the second layer.

Figure 9:
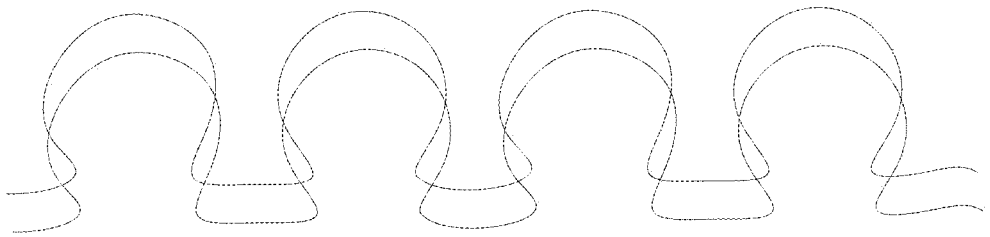
FIG. 9 is a schematic diagram illustrating the mesh layer of FIG. 7 in a compressive state according to some embodiments of the present disclosure.

FIG. 9 is a schematic diagram illustrating the mesh layer 700 of FIG. 7 in a compressive state according to some embodiments of the present disclosure. As shown in FIG. 9, when the mesh layer 700 is in the compressive state, the Ω-shaped elements in the first layer may extend toward the Ω-shaped elements in the second layer along the axial direction of the mesh layer 700. The bottom part of a Ω-shaped element in the first layer may reside close to the head part of a corresponding Ω-shaped element in the second layer.

The mesh layer 700 may have different lengths along the axial direction in the tensional state and the compressive state. For example, the length of the mesh layer 700 in the tensional state may be multiple times of the length of the mesh layer 700 in the compressive state. Merely by way of example, the tensional length of the mesh layer 700 under a stretching force (e.g., 3N) may be a first value. The compressive length of the mesh layer 700 under a compressive force (e.g., 3N) may be a second value. The ratio between the first value and the second value may be in a range of 2 to 4.

In some embodiments, when enclosed in a protection layer (e.g., the protection layer 201), different portions of the mesh layer 700 may be in different states. For example, the portion of the mesh layer 700 disposed at a corner of a thermal appliance may be in the compressive state. Another portion of the mesh layer 700 disposed of away from the corner of the thermal appliance may be in the tensional state.

In some embodiments, different states of the mesh layer may be sustained in the mesh layer 700 by the fasteners described elsewhere in the disclosure. For example, a portion of the mesh layer 700 may be kept in a compressive state by at least two fasteners. The at least two fasteners may restrict the portion of the mesh layer from stretching along the axial direction of the mesh layer 700.

Figure 10:
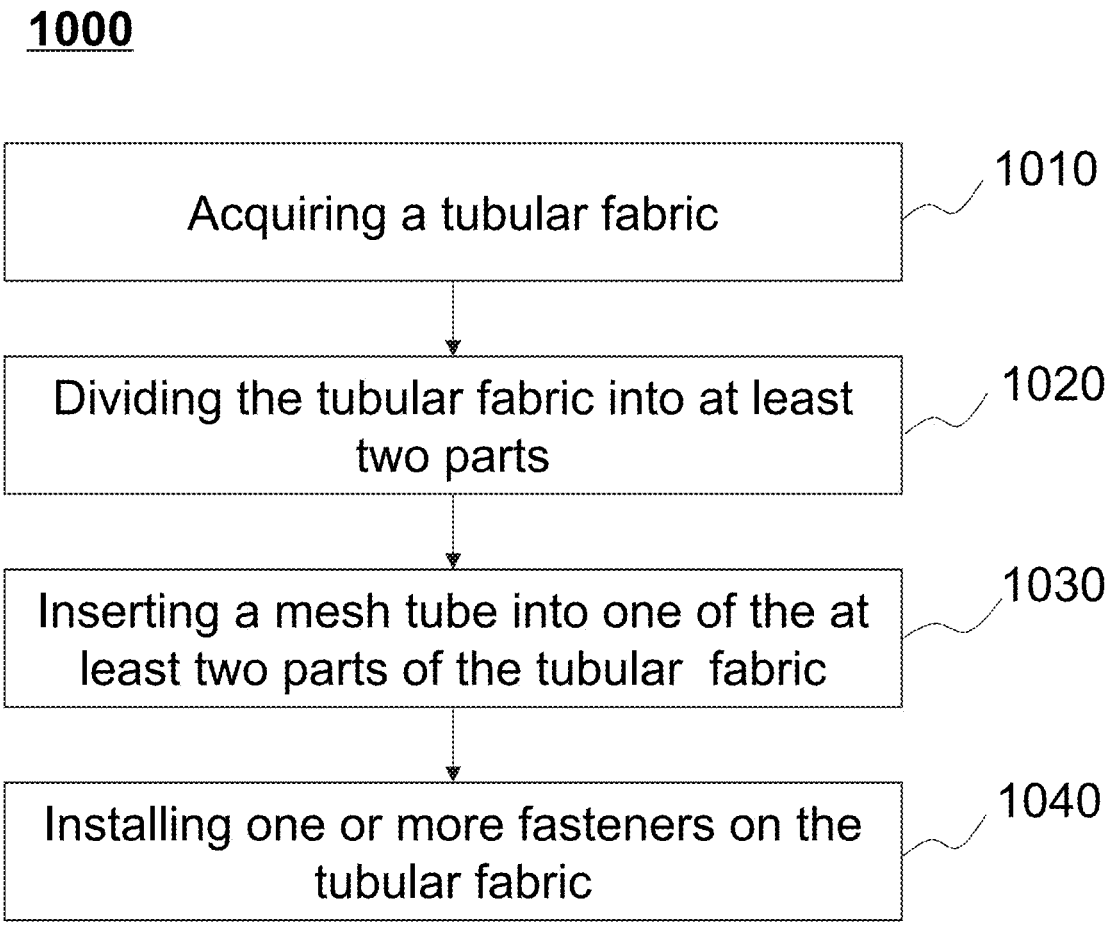
FIG. 10 is an exemplary flowchart of making a gasket according to some embodiments of the present disclosure.

FIG. 10 is an exemplary flowchart of making a gasket according to some embodiments of the present disclosure. In some embodiments, the process 1000 may be performed to make a gasket described elsewhere in the disclosure (e.g., the gasket 102 illustrated in FIG. 2).

In 1010, a tubular fabric may be acquired. In some embodiments, the tubular fabric may be knitted from a plurality of yarns as described in connection with, for example, the protection layer 201.

In 1020, the tubular fabric may be divided into at least two parts. Merely by way of example, the at least two parts may be formed by stitching the tubular fabric along a line parallel to the axis of the tubular fabric. The at least two parts may include a first tube and a second tube. The first tube may have a similar shape to the shape of the protection layer 201, and the second tube may have a similar shape to the shape of the extension section 211.

In 1030, a mesh tube may be inserted into one of the at least two parts of the tubular fabric. In some embodiments, the mesh tube may be similar to the mesh layer 202 illustrated in FIG. 2.

In 1040, one or more fasteners may be installed on the tubular fabric. The one or more fasteners may be installed on the one of the at least two parts of the tubular fabric, which may enclose the mesh tube. The one or more fasteners may be similar to the fastener 203 illustrated in FIG. 2.

It should be noted that the above description is merely provided for the purposes of illustration, and not intended to limit the scope of the present disclosure. For persons having ordinary skills in the art, multiple variations or modifications may be made under the teachings of the present disclosure. However, those variations and modifications do not depart from the scope of the present disclosure. For example, the operation 1020 may be unnecessary and omitted. The tubular fabric may be knitted to include at least two separate parts which is similar to the gasket 400 illustrated in FIG. 4. In some embodiments, process 600 may further include outputting the high-dose image data generated in 606.

Having thus described the basic concepts, it may be rather apparent to those skilled in the art after reading this detailed disclosure that the foregoing detailed disclosure is intended to be presented by way of example only and is not limiting.

Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation. Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electromagnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of elements, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped in a single embodiment, figure, or description thereof to streamline the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

I claim:

1. A gasket, comprising:

a tubular section having a protection layer and a mesh layer;

an extension section extending outward in a radial direction of the tubular section; and a plurality of fasteners installed on the protection layer; wherein the protection layer forms a first tube;

the mesh layer forms a second tube and is at least partially enclosed in the first tube; and one of the plurality of fasteners has a base portion and a dart portion, the base portion being within the second tube, and the dart portion forming an angle with a plane defined by an axis of the extension section and an axis of the tubular section, the angle being smaller than 90 degrees.

2. The gasket of claim 1, wherein the mesh layer is formed by a metal wire in a spiral fashion extending along an axial direction of the second tube.

3. The gasket of claim 2, wherein the metal wire forming the mesh layer includes a plurality of Ω-shaped elements, wherein a bottom part of one Ω-shaped element of the plurality of Ω-shaped elements integrates with a bottom part of another Ω-shaped element of the plurality of Ω-shaped elements, the one Ω-shaped element abutting the another Ω-shaped element.

4. The gasket of claim 3, wherein:

the plurality of Ω-shaped elements form a plurality of layers of Ω-shaped elements along the axial direction of the second tube, the plurality of Ω-shaped elements having a first layer of Ω-shaped elements and a second layer of Ω-shaped elements, the first layer abutting the second layer in the axial direction of the second tube;

each of Ω-shaped elements of the first layer threads through a corresponding Ω-shaped element of the second layer;

a portion of the each Ω-shaped element in the first layer is above the corresponding Ω-shaped element in the second layer in a radial direction of the second tube; and another portion of the each Ω-shaped element in the first layer is under the corresponding Ω-shaped element in the second layer in the radial direction of the second tube.

5. The gasket of claim 4, wherein the Ω-shaped elements of the first layer are movable with respect to the Ω-shaped elements of the second layer.

6. The gasket of claim 2, wherein the metal wire is made of stainless steel.

7. The gasket of claim 1, wherein the protection layer is formed by a thread of glass fiber.

8. The gasket of claim 1, the extension section being integrated with the protection layer.

9. The gasket of claim 8, further comprising a plurality of stitches, the plurality of stitches forming a line parallel to the axial direction of the tubular section, wherein the extension section has two sides, the plurality of stitches tying the two sides of the extension section together.

10. The gasket of claim 8, wherein the tubular section has a first width in a squashed state, the extension section has a second width in a squashed state, a ratio between the second width and the first width being in a range of 1/5 to 3/5.

11. The gasket of claim 1, wherein an interval between two adjacent fasteners of the plurality of fasteners is a fixed value or a random value.

12. The gasket of claim 1, wherein an end of the dart portion of the one of the plurality of fasteners bends toward an inner edge of the dart portion.

13. The gasket of claim 1, wherein the protection layer has an inner surface and an outer surface, at least one of the inner surface or the outer surface being coated with a lubricant material.

14. The gasket of claim 13, wherein the lubricant material includes graphite.

15. The gasket of claim 1, wherein the mesh layer provides an elastic support to the protection layer when the protection layer tube is pressed by an external force.

16. The gasket of claim 1, wherein the tubular section having an additional mesh layer, the additional mesh layer being enclosed in the mesh layer.

17. A method for making a gasket, comprising:

acquiring a tubular fabric;

dividing the tubular fabric into at least two parts by stitching the tubular fabric along a line parallel to an axis of the tubular fabric, the at least two parts including a protection tube and an extension section, the extension section extending outward in a radial direction of the protection tube;

inserting a mesh tube into the protection tube, the mesh tube being formed by a mesh layer and at least partially enclosed in the protection tube; and installing one or more fasteners on the protection tube, wherein one of the one or more fasteners has a base portion and a dart portion, the base portion being within the mesh tube, and the dart portion forming an angle with a plane defined by an axis of the extension section and an axis of the protection tube, the angle being smaller than 90 degrees.

18. The method of claim 17, wherein the tubular fabric is knitted from a plurality of yarns.

19. The method of claim 17, wherein the mesh layer is formed by a metal wire in a spiral fashion extending along an axial direction of the mesh tube.

20. The method of claim 19, wherein the metal wire forming the mesh layer includes a plurality of Ω-shaped elements, wherein a bottom part of one Ω-shaped element of the plurality of Ω-shaped elements integrates with a bottom part of another Ω-shaped element of the plurality of Ω-shaped elements, the one Ω-shaped element abutting the another Ω-shaped element.

* * * * *